US008777395B2

(12) United States Patent
Mitsuzawa

(10) Patent No.: US 8,777,395 B2
(45) Date of Patent: Jul. 15, 2014

(54) LIQUID EJECTING APPARATUS AND LIQUID EJECTING METHOD

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 13/454,263

(22) Filed: Apr. 24, 2012

(65) Prior Publication Data

US 2012/0281039 A1 Nov. 8, 2012

(30) Foreign Application Priority Data

May 2, 2011 (JP) ..... 2011-103113

(51) Int. Cl.
*B41J 2/01* (2006.01)
*B41J 29/38* (2006.01)

(52) U.S. Cl.
USPC ..... 347/102; 347/17

(58) Field of Classification Search
USPC ..... 347/102, 17
See application file for complete search history.

(56) References Cited

U.S. PATENT DOCUMENTS 7,682,013 B2 3/2010 Hoshino
2003/0022403 A1* 1/2003 Shimoda et al. ..... 438/14
2011/0069128 A1* 3/2011 Onishi ..... 347/102

FOREIGN PATENT DOCUMENTS

JP 2006-289722 10/2006

* cited by examiner

*Primary Examiner* — Sarah Al Hashimi
(74) *Attorney, Agent, or Firm* — Workman Nydegger

(57) ABSTRACT

A liquid ejecting apparatus includes a carriage that has a head ejecting liquid cured by receiving the irradiation of light and moves in a movement direction intersecting a transportation direction of a medium; a first irradiation section; a second irradiation section; and a controller that forms the image on the medium through performing an ejection operation ejecting the liquid from the head while moving the carriage in the movement direction and a transportation operation that transports the medium in the transportation direction, and performs control of the irradiation intensity of the light of the first irradiation section at the time of the ejection operation to regulate the surface condition of the image and to change the irradiation intensity of the light of the second irradiation section according to the irradiation intensity of the light of the first irradiation section.

6 Claims, 9 Drawing Sheets

| RECORDING MODE | FINISH | IRRADIANCE SETTING | |
|---|---|---|---|
| | | 42a, 42b | 43a, 43b |
| FAST (TWO PASSES) | A (MAT) | 5 | 2 |
| | B | 3.5 | 3.5 |
| | C (GLOSS) | 2 | 5 |
| HIGH IMAGE QUALITY (FOUR PASSES) | A (MAT) | 4 | 1 |
| | B | 2.5 | 2.5 |
| | C (GLOSS) | 1 | 4 |

LIQUID EJECTING APPARATUS AND LIQUID EJECTING METHOD

BACKGROUND

1. Technical Field

The present invention relates to a liquid ejecting apparatus and a liquid ejecting method.

2. Related Art

A liquid ejecting apparatus is known in which printing is performed using a liquid (for example, ultraviolet ray (UV) ink) cured by receiving irradiation of light (for example, UV ink). Such a liquid ejecting apparatus includes an irradiation section irradiating light and irradiates the light from the irradiation section to dots after the liquid is ejected to the medium and the dots are formed. As described above, the dots are cured and fixed on the medium so that printing can also be performed to the medium on which the liquid is difficult to absorb. In addition, as the liquid ejecting apparatus described above, a liquid ejecting apparatus is known in which a carriage moving in the movement direction includes a head ejecting the liquid and an irradiation section arranged at the upstream side or the downstream side from the head in the movement direction (for example, JP-A-2006-289722). In this case, when the carriage moves in the movement direction, ejecting of the liquid from the head to the medium and irradiating of the light to the dots formed on the medium can be performed.

Depending on the application, there are cases where the feeling of the image is changed when printing is performed. In the liquid ejecting apparatus as described above, irradiation intensity of the light is changed just after dot formation and the feeling of the image may be changed. However, when the irradiation intensity of the light is changed, for example, there is a concern that the dots may not be completely cured or that energy is wasted.

SUMMARY

An advantage of some aspects of the invention is that it provides a liquid ejecting apparatus and a liquid ejecting method to print a desired image while achieving optimization of the irradiation conditions of light.

According to an aspect of the invention, a liquid ejecting apparatus includes a carriage that has a head ejecting liquid cured by receiving the irradiation of light and moves in a movement direction intersecting a transportation direction of a medium; a first irradiation section that is disposed at the carriage, irradiates the light and is arranged at the upstream side or the downstream side from the head in the movement direction; a second irradiation section that irradiates the light and is arranged at the downstream side from the first irradiation section in the transportation direction; and a controller that forms the image on the medium through performing an ejection operation ejecting the liquid from the head while moving the carriage in the movement direction and a transportation operation that transports the medium in the transportation direction, and performs control of the irradiation intensity of the light of the first irradiation section at the time of the ejection operation to regulate the surface condition of the image and to change the irradiation intensity of the light of the second irradiation section according to the irradiation intensity of the light of the first irradiation section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
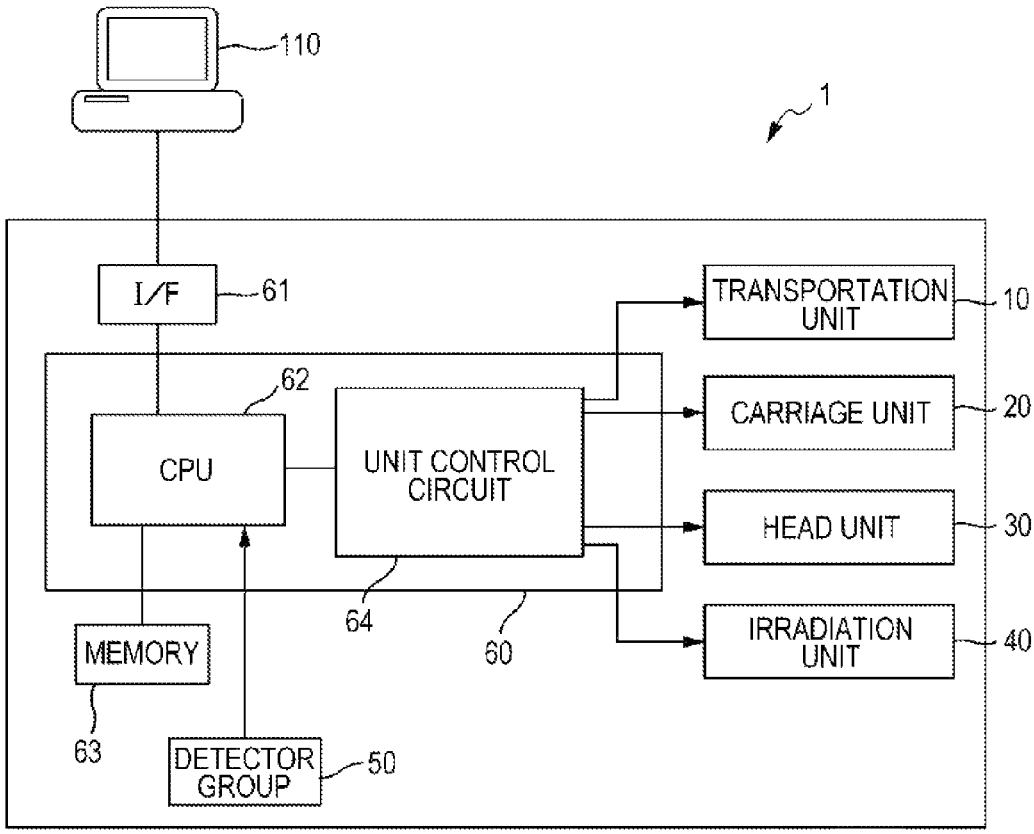
FIG. 1 is a block diagram illustrating a configuration of a printer.

It is clear that the liquid ejecting apparatus includes a carriage that has a head ejecting liquid cured by receiving the irradiation of light and moves in a movement direction intersecting a transportation direction of a medium; a first irradiation section that is disposed at the carriage, irradiates the light and is arranged at the upstream side or the downstream side from the head in the movement direction; a second irradiation section that irradiates the light and is arranged at the downstream side from the first irradiation section in the transportation direction; and a controller that forms the image on the medium through performing an ejection operation ejecting the liquid from the head while moving the carriage in the movement direction and a transportation operation that transports the medium in the transportation direction, and performs control of the irradiation intensity of the light of the first irradiation section at the time of the ejection operation to regulate the surface condition of the image and to change the irradiation intensity of the light of the second irradiation section according to the irradiation intensity of the light of the first irradiation section.

According to the liquid ejecting apparatus, the light is irradiated from the first irradiation section so that the feeling of the image can be regulated and the amount of the light can be secured to completely cure the dots by receiving the irradiation of the light from the second irradiation section. Accordingly, a desired image can be printed while achieving the optimization of the irradiation condition.

It is preferable that the controller allow the irradiation intensity of the light of the first irradiation section to be a first intensity and the irradiation intensity of the light of the second irradiation section to be a second intensity when the image is a certain surface condition, and wherein the controller allows the irradiation intensity of the light of the first irradiation section to decrease less than the first intensity and the irradiation intensity of the light of the second irradiation section to increase more than the second intensity when the image has a surface condition of a gloss higher than the certain surface condition.

According to the liquid ejecting apparatus, a suitable irradiation condition can be set for the surface condition of the image to be formed.

It is preferable that when the controller performs a first print mode that forms dots at a predetermined region of the medium through performing the ejection operation n times (n is a natural number), or a second print mode that forms dots at the predetermined region through performing the ejection operation m times (m is a natural number larger than n) and then the image of the predetermined surface condition is printed, the irradiation intensity of the light of each of the irradiation sections in the second print mode is decreased less than the irradiation intensity of the light of each of the irradiation sections in the first print mode.

According to the liquid ejecting apparatus, the irradiation condition suitable for the print mode can be set.

It is preferable that the controller performs the irradiation operation that allows each of irradiation sections to irradiate the light while moving the carriage in the movement direction without ejecting the liquid from the head between the ejection operation and the transportation operation.

According to the liquid ejecting apparatus, the image formed on the medium can be further reliably cured.

It is preferable that the controller changes the irradiation intensity of the light of the first irradiation section and the second irradiation section according to types of media.

According to the liquid ejecting apparatus, the irradiation condition of the light can be further optimized.

It is preferable that the second irradiation section is disposed at the carriage.

According to the liquid ejecting apparatus, even though the length of the second irradiation section in the movement direction is shorter than the width of the medium, the second irradiation section moves with the carriage in the movement direction so that the light can be irradiated to the image (the image after the light is irradiated by the first irradiation section) formed on the medium by the head. Accordingly, miniaturization of the second irradiation section can be achieved compared to the case where the second irradiation section is disposed through a length equal to or greater than the width of the printable medium.

It is clear that in a liquid ejecting method that forms an image on a medium through performing a transportation operation that transports the medium in the transportation direction and an ejection operation ejecting liquid from a head with the irradiation of the light while moving a carriage having the head in a movement direction intersecting the transportation direction, the method includes regulating the surface condition of the image with controlling the irradiation intensity of the light of a first irradiation section that is disposed at the carriage and arranged at the upstream side or the downstream side from the head in the movement direction at the time of the ejection operation; and changing the irradiation intensity of the light of a second irradiation section disposed at the downstream side from the first irradiation section in the transportation direction according to the irradiation intensity of the light of the first irradiation section.

In the embodiments below, an ink jet printer (hereinafter, also referred to as a printer 1) will be described as an example of the liquid ejecting apparatus.

First Embodiment

Configuration of Printer

Figure 2:
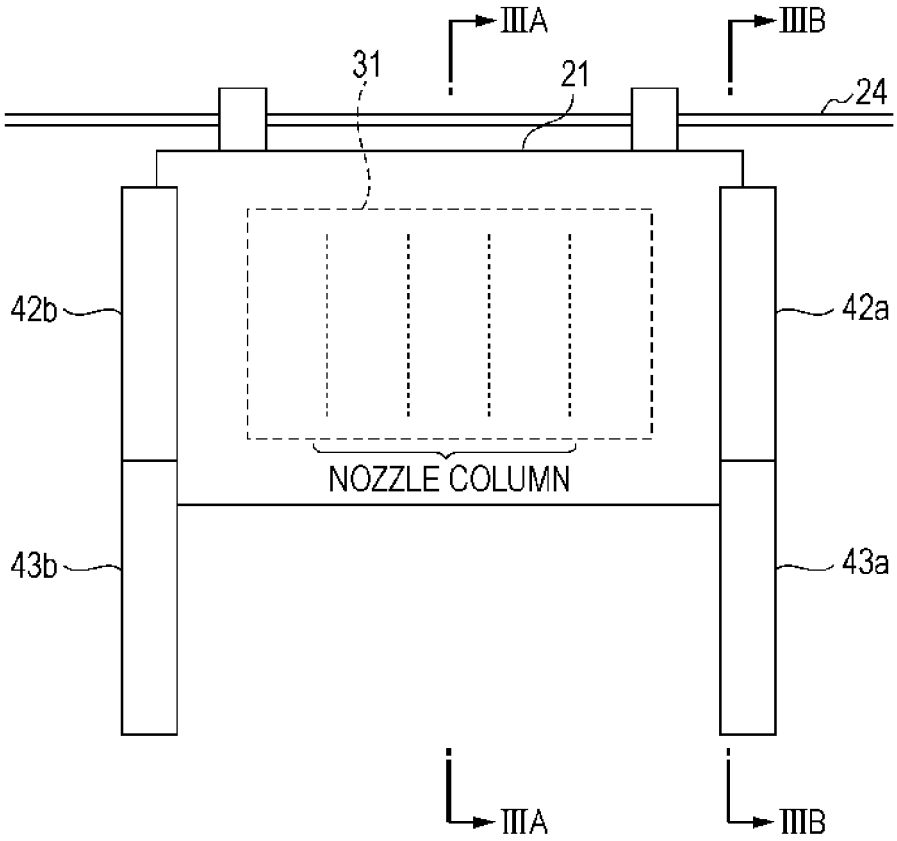
FIG. 2 is a schematic view of a periphery of a head of a printer.
Figure 2:
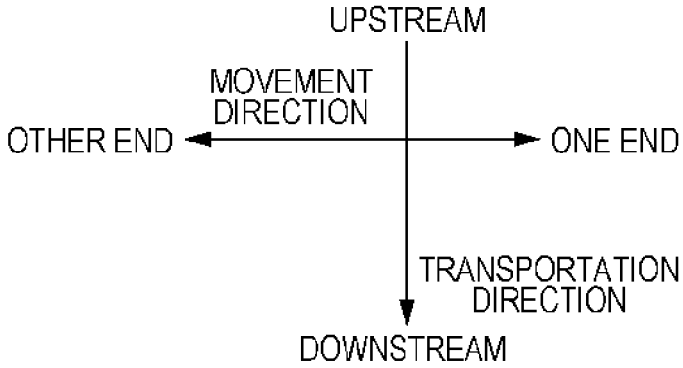
Figure 3A:
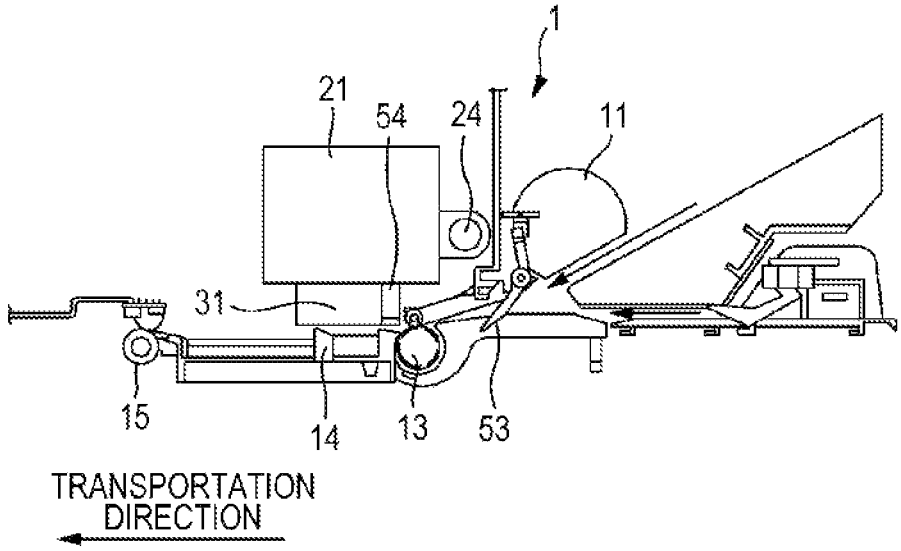
FIGS. 3A and 3B are cross-sectional views of a printer.
Figure 3B:
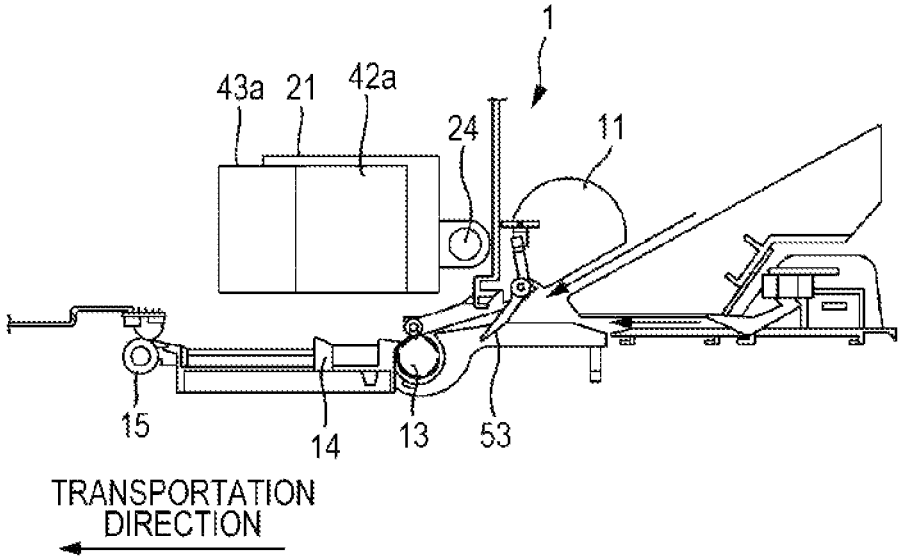

Hereinafter, a printer 1 of the embodiment will be described with reference to FIGS. 1, 2, 3A and 3B. FIG. 1 is a block diagram illustrating a configuration of the printer 1. FIG. 2 is a schematic view of a periphery of a head of the printer 1. FIGS. 3A and 3B are cross-sectional views of the printer 1. FIG. 3A is taken along IIIA-IIIA line in FIG. 2 and FIG. 3B is taken along IIIB-IIIB line in FIG. 2.

The printer 1 of the embodiment is an apparatus printing an image on the medium by ejecting ultraviolet curable ink (hereinafter, also referred to as a UV ink) to the medium such as paper, cloth, a film sheet or the like. The ultraviolet curable ink is cured by receiving the irradiation of ultraviolet rays (hereinafter, also referred to as UV) that is a type of light. The UV ink is an ink including an ultraviolet curable resin and is cured due to a light polymerization reaction in the ultraviolet curable resin when receiving the irradiation of UV. In addition, the printer 1 of the embodiment prints the image using four colors of UV ink of CMYK.

The printer 1 has a transportation unit 10, a carriage unit 20, a head unit 30, an irradiation unit 40, a detector group 50 and a controller 60. The printer 1 receives print data from a computer 110 that is an external apparatus that performs the control of each unit (the transportation unit 10, the carriage unit 20, the head unit 30 and the irradiation unit 40) with the controller 60. The controller 60 performs control of each unit and prints the image on the medium based on the print data received from the computer 110. The situation inside the printer 1 is monitored by the detector group 50 and the detector group 50 outputs the result of the detection to the controller 60. The controller 60 performs the control of each unit based on the result of the detection output from the detector group 50.

The transportation unit 10 is for transporting the medium (for example, the paper) in a predetermined direction (hereinafter, referred to as the transportation direction). The transportation unit 10 has a paper feeding roller 11, a transportation motor (not shown), a transportation roller 13, a platen 14 and a paper discharging roller 15. The paper feeding roller 11 is a roller for feeding the medium inserted in a paper inserting port into the printer. The transportation roller 13 is a roller transporting the medium that is fed by the paper feeding roller 11 to a printable region and is driven by a transportation motor. The platen 14 supports the medium that is in the printing. The paper discharging roller 15 is a roller discharging the medium outside the printer and is disposed at the downstream side with respect to the printable region in the transportation direction.

The carriage unit 20 moves (also referred to as "scanning") the head in a predetermined direction (hereinafter, referred to as a movement direction). The carriage unit 20 has a carriage 21 and a carriage motor (not shown). In addition, the carriage 21 detachably holds the ink cartridge accommodating the UV ink. Thus, the carriage 21 reciprocates along the guide shaft 24 with the carriage motor in a supported state at the guide shaft 24 intersecting the transportation direction (described below).

The head unit 30 is for ejecting the liquid (the UV ink in the embodiment) on the medium. The head unit 30 includes a head 31 having a plurality of nozzles. Since the head 31 is disposed at the carriage 21, when the carriage 21 moves in the movement direction, the head 31 also moves in the movement direction. Thus, the UV ink is intermittently ejected when the head 31 moves in the movement direction so that a dot line (a raster line) is formed on the medium along the movement direction. In addition, hereinafter, a route moving from one end to the other end in FIG. 2 is referred to as an outward trip and a route moving from the other end to one end is referred to as a return trip. In the embodiment, the UV ink is ejected from the head 31 at both periods of the outward trip and the return trip. In other words, the printer 1 of the embodiment performs bi-directional printing.

In addition, the configuration of the head 31 will be described.

The irradiation unit 40 irradiates the UV to the UV ink on the medium. The dot formed on the medium is cured through receiving irradiation of the UV from the irradiation unit 40. The irradiation unit 40 of the embodiment includes first irradiation sections 42*a* and 42*b*, and second irradiation sections 43*a* and 43*b*. In the embodiment, each of the irradiation sections (the first irradiation sections 42*a* and 42*b*, and the second irradiation sections 43*a* and 43*b*) is disposed at the carriage 21. Thus, when the carriage 21 moves in the movement direction, the first irradiation sections 42*a* and 42*b* and the second irradiation sections 43*a* and 43*b* also move in the movement direction.

The first irradiation sections 42*a* and 42*b* are disposed at one end and the other end of the head 31 respectively on the carriage 21 in the movement direction so as to interpose the head 31. The length of the first irradiation sections 42*a* and 42*b* in the transportation direction is substantially the same as the length of the nozzle column of the head 31. In other words, the first irradiation sections 42*a* and 42*b* are disposed at positions lined up with the nozzle columns of the head 31 in the movement direction. Thus, the first irradiation sections 42*a* and 42*b* move together with the head 31 to irradiate the UV in the range where the nozzle column of the head 31 forms the dot. The first irradiation sections 42*a* and 42*b* of the embodiment use a light emitting diode (LED) as the UV light source. The LED controls the size of an input current so that irradiation energy can be easily changed. A plurality of LEDs is arranged along the transportation direction in first irradiation sections 42*a* and 42*b*. Thus, the ON-OFF state of each of the LEDs is controlled so that the irradiation range (the range in the transportation direction) of the UV can be set. For example, if only half of the nozzle columns of the head 31 in the downstream side in the transportation direction are used, the half of the nozzles can irradiate the UV with respect to the range forming the dots.

The second irradiation sections 43*a* and 43*b* are disposed at the downstream side of the first irradiation sections 42*a* and 42*b* in the transportation direction respectively. In addition, the length of the second irradiation sections 43*a* and 43*b* in the transportation direction is the same as the length (in other words, the length of the nozzle column of the head 31) of the first irradiation sections 42*a* and 42*b* in the transportation direction. In addition, even in the second irradiation sections 43*a* and 43*b*, similar to the first irradiation sections 42*a* and 42*b*, a plurality of LEDs are disposed along the transportation direction as the light source of the UV irradiation. The ON-OFF state of each of the LEDs is controlled so that the range of the UV irradiation can be set.

In addition, the UV irradiation through the first irradiation sections 42*a* and 42*b*, and the second irradiation sections 43*a* and 43*b* will be described detail below.

The detector group 50 includes a linear type encoder (not shown), a rotary type encoder (not shown), a paper detection sensor 53, the photosensor 54 or the like. The linear type encoder detects the position of the carriage 21 in the movement direction. The rotary type encoder detects the amount of rotation of the transportation roller 13. The paper detection sensor 53 detects a position of a front end of the medium during feeding the paper. The photosensor 54 detects whether or not the medium is present by a light emitting section and a light receiving section attached at the carriage 21. Thus, the photosensor 54 detects the position of the end of the medium while moving by the carriage 21 and the width of the medium can be detected. In addition, the photosensor 54 can also detect the front end (that is the end to the downstream side in the transportation direction and also referred to as the upper end) and the rear end (that is the end to the upstream side in the transportation direction and also referred to as the lower end) of the medium according to the situation.

The controller 60 is a control unit (a control section) for performing the control of the printer 1. The controller 60 has an interface section 61, a CPU 62, a memory 63 and a unit control circuit 64. The interface section 61 performs transmitting and receiving of the data between the computer 110 that is the exterior apparatus and the printer 1. The CPU 62 is an arithmetic processing unit for performing the control of the entire printer 1. The memory 63 is for reserving a region accommodating program of the CPU 62, a work region or the like, and has a storage element such as a RAM, an EEPROM, or the like. The CPU 62 performs the control of each unit via unit control circuit 64 according to the program accommodated in the memory 63.

When printing is performed, as described below, the controller 60 alternately repeats an ejection operation ejecting the UV ink from the head 31 during moving in the outward trip direction and the return trip direction, and transportation operation transporting the medium in the transportation direction. The image configured of a plurality of dots is printed on the medium. In the description below, the ejection operation is referred to as "a pass". In addition, $n^{th}$ pass is referred to as pass n. In the event of the pass, as described below, the irradiation of the UV to the dots formed on the medium is also performed.

Printing Procedure

The controller 60 performs process described below, to each unit of the printer 1 when printing the print data received from the computer 110.

First, the controller 60 rotates the paper feeding roller 11 and transports the medium to be printed (here, a paper S) as far as the transportation roller 13. Next, the controller 60 drives a transportation motor (not shown) so as to rotate the transportation roller 13. When the transportation roller 13 rotates by a predetermined amount of rotation, the paper S is transported with a predetermined amount of the transportation.

When the paper S is transported to the lower portion of the head 31, the controller 60 rotates the carriage motor (not shown). The carriage 21 moves in the movement direction according to the rotation of the carriage motor. In addition, the carriage 21 moves in the transportation direction so that the head 31, the first irradiation sections 42*a* and 42*b* and the second irradiation sections 43*a* and 43*b* disposed at the carriage 21 also move in the movement direction at the same time. Thus, during moving in the movement direction, the controller 60 allows the ink droplets to eject intermittently from the head 31. The ink droplets impact the paper S so that the dot column is formed where a plurality of dots is arranged in the movement direction. In addition, when the carriage 21 movies in the movement direction, the controller 60 allows the UV irradiation to selectively perform from each of the irradiation sections of the irradiation unit 40.

In addition, the controller 60 allows the transportation motor to drive in the interval of the reciprocating of the head 31. The transportation motor generates the driving force in the rotation direction according to the amount of the driving instructed from the controller 60. Using the driving force, the transportation motor rotates the transportation roller 13. When the transportation roller 13 rotates by a predetermined amount of rotation, the paper S is transported with the predetermined amount of the transportation. In other words, the amount of the transportation of the paper S is determined according to the amount of rotation of the transportation roller 13. As described above, the pass (and the UV irradiation) and the transportation operation of the paper S are alternately and repeatedly performed by reciprocation of the head 31, and the dots are formed on each of the pixels of the paper S.

The paper S where the printing has been finished is discharged by the paper discharging roller 15 rotating synchronized with the transportation roller 13.

In this way, the image is printed on the paper S.

Configuration of Head 31

Figure 4:
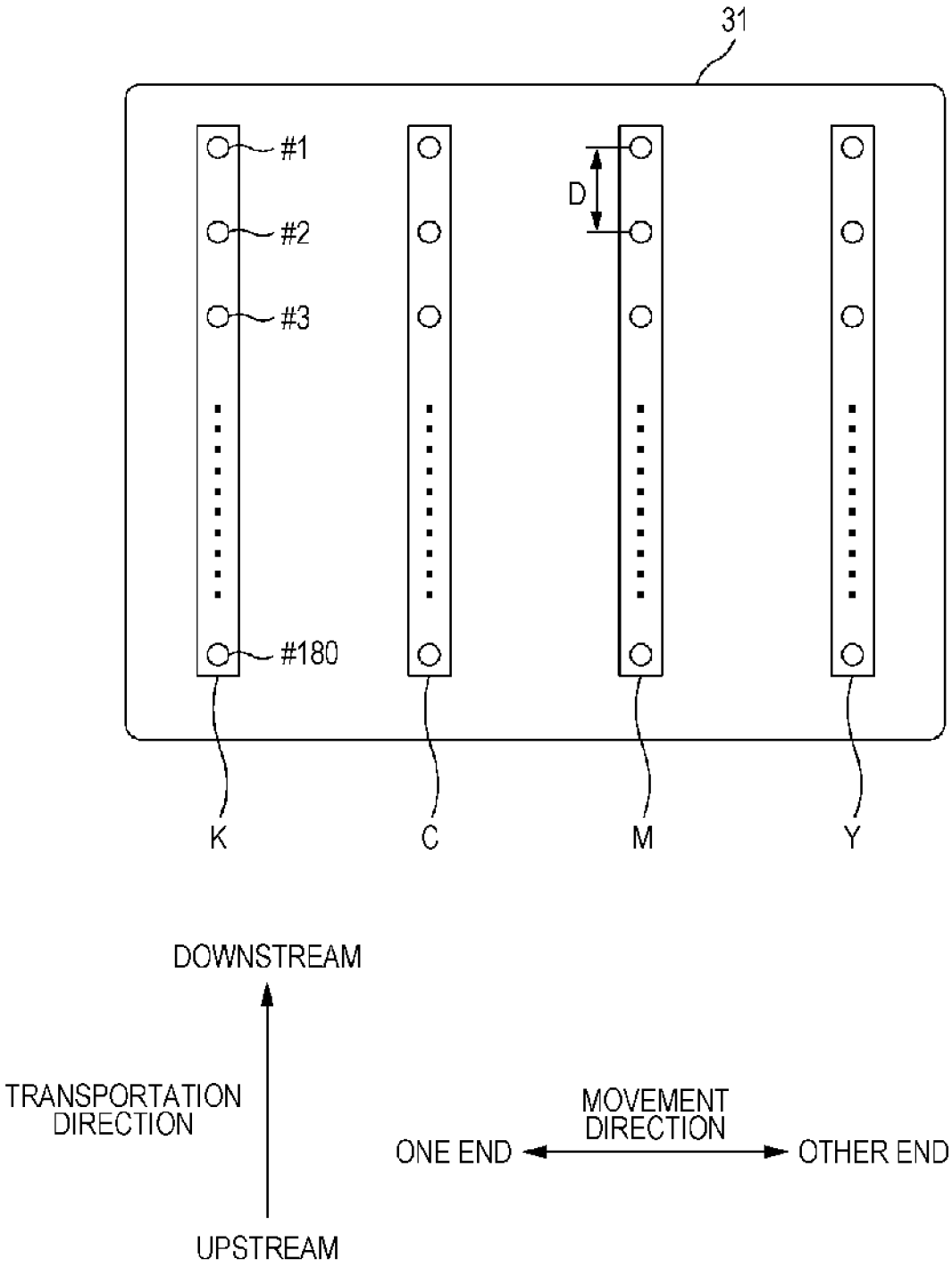
FIG. 4 is an explanatory view of a configuration of a head.

FIG. 4 is an explanatory view of an example of a configuration of the head 31. As shown in FIG. 4, the lower surface of the head 31 forms a black ink nozzle column K, a cyan ink nozzle column C, a magenta ink nozzle column M and a yellow ink nozzle column Y. Each of nozzle columns includes a plurality of nozzles (for example, 180 in the embodiment) which are ejecting ports for ejecting the UV ink of each color. In the embodiment, the nozzles of each of the nozzle columns are disposed with a nozzle pitch D (for example, 360 dpi) along the transportation direction.

The nozzles of each of nozzle columns are have numbers that descend to the downstream side in the transportation direction attached. A piezoelectric element (not shown) is disposed at each of nozzles as a driving element for ejecting the UV ink from each of nozzles. The piezoelectric element is driven by the driving signal so that the droplet-shaped UV ink is ejected from each of nozzles. The ejected UV ink impacts the medium and forms the dots.

Method of Dot Formation

The printer 1 of the embodiment performs a printing method (hereinafter, also referred to as two passes) that performs the printing of the region of the length of the nozzle pitch in two passes and a printing method (hereinafter, also referred to as four passes) that performs in four passes. Hereinafter, the dot formation methods of two passes and four passes will be described.

Case of Two Passes

The two pass dot formation method will be described.

Figure 5:
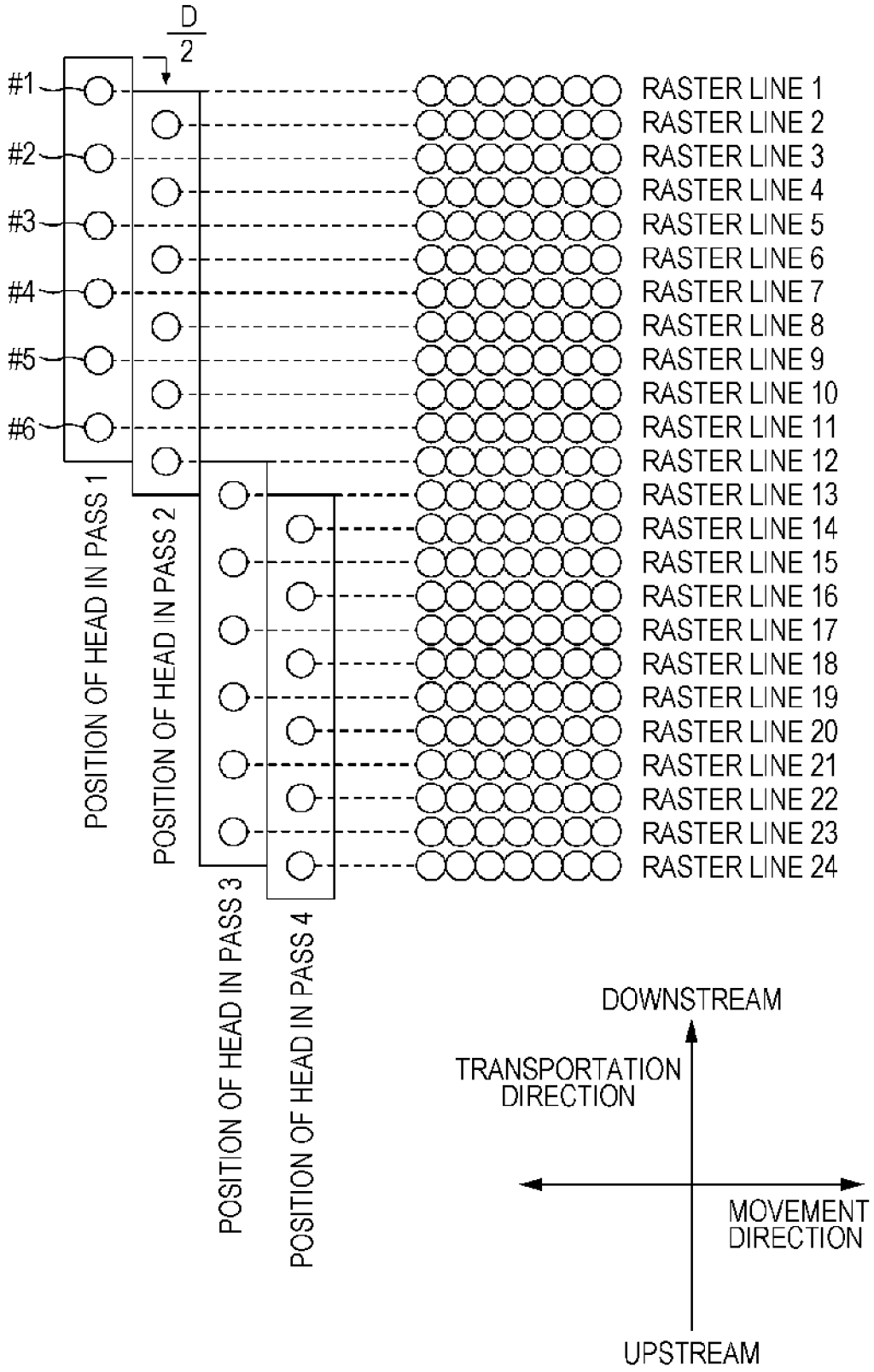
FIG. 5 is an explanatory view of a method of a dot formation of two-pass.

FIG. 5 is an explanatory view of an example of the two pass dot formation method. In the view, for simplicity of description, one nozzle column (for example, the black nozzle column) in four nozzle columns is illustrated. In addition, for simplicity of description, the number of nozzle columns is six.

As described above, when performing the print, the controller 60 performs alternately and repeatedly the ejection operation (the pass) ejecting the ink from the head 31 at the time of moving in the movement direction, and the transportation operation transporting the medium in the transportation direction. Circles in the right in the view illustrate the dots. In addition, for convenience of description, the nozzle column moves in the transportation direction (the up-down direction in the view) in every pass, and it illustrates the relative position of the nozzle column with respect to the medium in the same view. Practically, the medium is transported (moved) in the transportation direction.

In a first pass, the controller 60 allows the ink to eject from each of the nozzles while moving the head 31 in the movement direction. Accordingly, the dot is formed on the medium at positions (an odd-numbered raster line) corresponding to each of the nozzles.

In the transportation operation after the first pass, the controller 60 allows the medium to be transported as much as the half (D/2=0.5D) of the nozzle pitch D in the transportation direction. Accordingly, the relative position of the head with respect to the medium moves 0.5D to the upstream side in the transportation direction.

Even in a second pass, the ink is ejected from each of the nozzles while moving the head 31 in the movement direction. Accordingly, the dot is formed on the medium at positions (an even-numbered raster line) corresponding to each of the nozzles. As seen from the view, in the second pass, for example, the dot column (the raster line 2) is formed by the nozzle #1 between the dot column (the raster line 1) formed at the nozzle #1 and the dot column (the raster line 3) formed at the nozzle #2 at the time of the first pass.

In the transportation operation after the second pass, the medium is moved 5.5D (=6D−0.5D) in the transportation direction. Accordingly, the relative position of the head 31 with respect to the medium moves 5.5D to the upstream side in the transportation direction. In other words, as shown in FIG. 5, the raster line 12 formed by the nozzle #6 in the second pass is positioned by the nozzle #1 to the downstream side 0.5D in the transportation direction.

Thus, even in a third pass, the ink is ejected from each of the nozzles while moving the head 31 in the movement direction. Accordingly, the dot is formed on the medium at positions (an odd-numbered raster line) corresponding to each of the nozzles. For example, the raster line (the raster line 13) is formed by the nozzle #1 of the third pass below the raster line (the raster line 12) formed by the nozzle #6 at the second pass.

In the transportation operation after the third pass, the medium is transported as much as the half (D/2=0.5D) of the nozzle pitch D in the transportation direction. Accordingly, the relative position of the head with respect to the medium moves as much as 0.5D to the upstream side in the transportation direction.

Even in the pass of a fourth time, the ink is ejected from each of the nozzles while moving the head 31 in the movement direction. Accordingly, the dot is formed on the medium at positions (an even-numbered raster line) corresponding to each of the nozzles.

Hereinafter, similar to the above description, the controller 60 allows the medium to be transported 0.5D in the transportation direction after the odd-numbered pass, and allows the medium to be transported 5.5D in the transportation direction after the even-numbered pass.

The operation is repeated so that the dot columns lined up in the movement direction and the transportation direction is formed on the medium.

Case of Four Passes

Next, the four pass dot formation method will be described.

Figure 6:
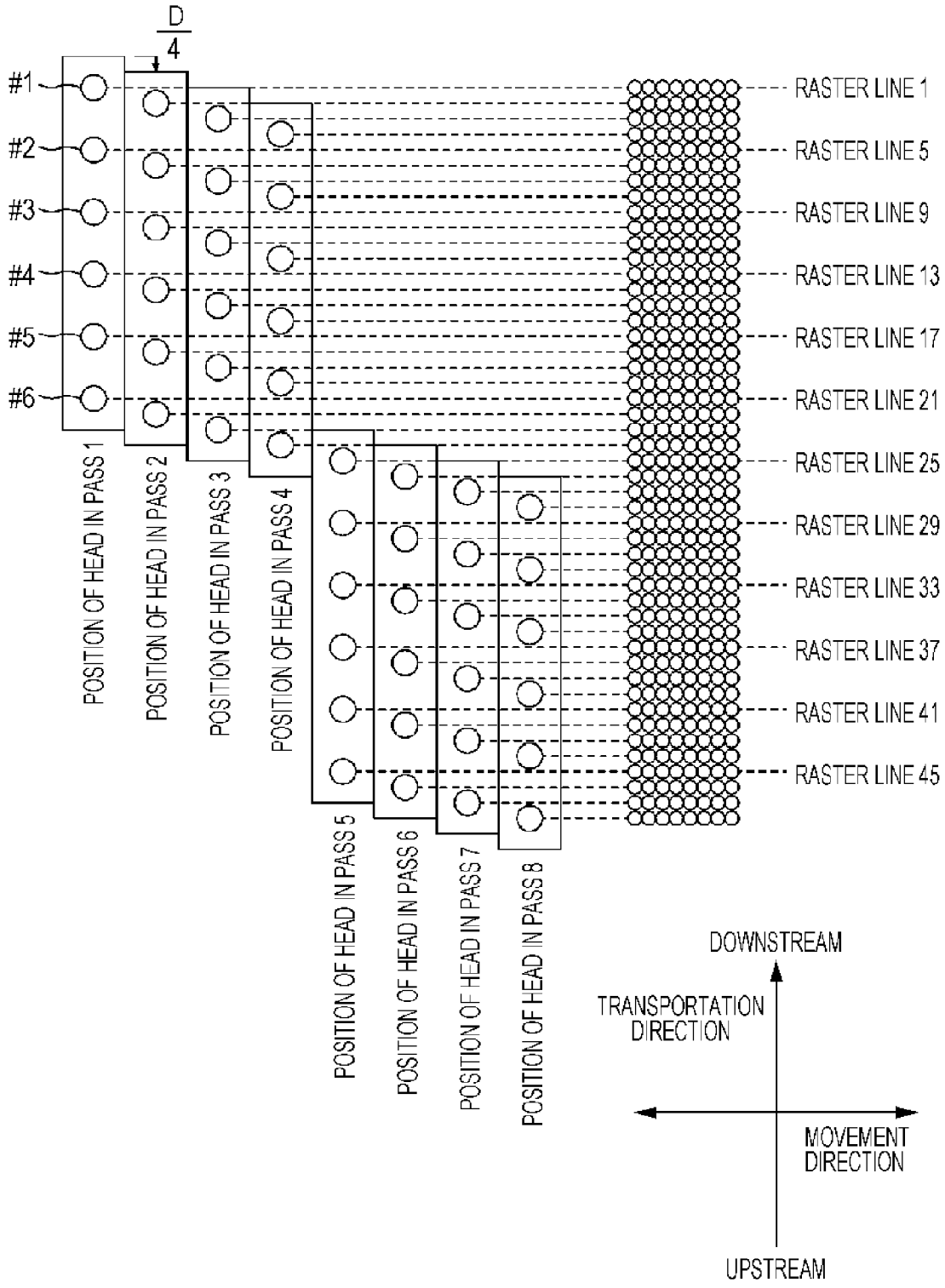
FIG. 6 is an explanatory view of a method of a dot formation of four-pass.

FIG. 6 is an explanatory view of an example of the four pass dot formation method. Even in FIG. 6, similar to FIG. 5, one nozzle column (for example, the black nozzle column) in four nozzle columns is illustrated. Also in this case, the number of nozzle columns is six.

As described above, when performing the print, the controller 60 performs alternately and repeatedly the dot formation operation (the pass) ejecting the ink from the head 31 at the time of moving in the movement direction, and the transportation operation transporting the medium in the transportation direction. Circles in the right in the view illustrate the dots.

In a first pass, the controller 60 allows the ink to eject from each of the nozzles while moving the head 31 in the movement direction. Accordingly, the dot column is formed on the medium at positions corresponding to each of the nozzles (the raster lines 1, 5, 9, 13, 17 and 21).

In the transportation operation after the first pass, the controller 60 allows the medium to be transported as much as D/4 (=0.25D) in the transportation direction. Accordingly, the relative position of the head with respect to the medium moves 0.25D to the upstream side in the transportation direction.

Even in a second pass, the controller 60 allows the ink to eject from each of the nozzles while moving the head 31 in the movement direction. The dot is formed on the medium at positions corresponding to each of the nozzles (the raster lines 2, 6, 10, 14, 18 and 22).

In addition, even in the transportation operation after the second pass, the controller 60 allows the medium to be transported 0.25D in the transportation direction. Accordingly, the relative position of the head with respect to the medium moves 0.25D to the upstream side in the transportation direction.

Even in a third pass, the controller 60 allows the ink to eject from each of the nozzles while moving the head 31 in the movement direction. The dot is formed on the medium at positions corresponding to each of the nozzles (the raster lines 3, 7, 11, 15, 19 and 23).

In addition, even in the transportation operation after the third pass, the controller 60 allows the medium to move 0.25D in the transportation direction. Accordingly, the relative position of the head with respect to the medium moves 0.25D to the upstream side in the transportation direction.

Even in a fourth pass, the controller 60 allows the ink to eject from each of the nozzles while moving the head 31 in the movement direction. The dot is formed on the medium at positions corresponding to each of the nozzles (the raster lines 4, 8, 12, 16, 20 and 24).

Thus, in the transportation operation after the fourth pass, the controller 60 allows the medium to move 5.25D (=6D-¾D) in the transportation direction. Accordingly, the relative position of the head with respect to the medium moves 5.25D to the upstream side in the transportation direction. For example, the nozzle #1 is corresponding to the position of the nozzle #6 to the upstream side in the transportation direction in the fourth pass.

Even in a fifth pass, the controller 60 allows the ink to eject from each of the nozzles while moving the head 31 in the movement direction. The dot is formed on the medium at positions corresponding to each of the nozzles (the raster lines 25, 29, 33, 37, 41 and 45).

Below, the pass and the transportation direction are repeated similarly.

As shown in the view, the dot columns lined up in the movement direction and the transportation direction are formed on the medium.

Irradiation of UV

In the embodiment, the UV is irradiated on the UV ink impacted on the medium so that the dots are cured. The printer 1 of the embodiment includes the first irradiation sections 42*a* and 42*b*, and the second irradiation sections 43*a* and 43*b* as the irradiation unit 40. The printer 1 performs two-step curing. The first irradiation sections 42*a* and 42*b* thereof perform the UV irradiation to suppress the flow (widening of the dots) of the UV ink impacted on the medium. Hereinafter, where the dots are cured to a degree of suppressing the widening of the dots is also referred to as a provisional curing. In addition, the dots after the provisional curing are not completely cured. In addition, the second irradiation sections 43*a* and 43*b* that are disposed to the downstream side from the first irradiation sections 42*a* and 42*b* in the transportation direction perform the UV irradiation to completely cure the dots. Hereinafter, when the dots are completely cured is also referred to as main curing.

As shown in FIG. 2, the first irradiation sections 42*a* and 42*b* are disposed at the carriage 21 respectively. The first irradiation section 42*a* is disposed at one end of the carriage 21 in the movement direction, and the first irradiation section 42*b* is disposed at the other end of the carriage 21 in the movement direction. Accordingly, the head 31 and the first irradiation sections 42*a* and 42*b* also move in the movement direction according to the moving of the carriage 21. In other words, when the nozzle column of each color of the head 31 reciprocates, the first irradiation sections 42*a* and 42*b* reciprocate while maintaining the relative position with respect to the nozzle column of each color. At this time, the controller 60 allows the UV to irradiate from the first irradiation sections 42*a* and 42*b* to the medium when reciprocating. More specifically, when the carriage 21 moves in the outward trip (from one end to the other end), the UV is irradiated from the first irradiation section 42*a*, and when the carriage 21 moves in the return trip (from the other end to one end), the UV is irradiated from the first irradiation section 42*b*. In other words, the UV is irradiated from the irradiation section of the upstream side in the movement direction with respect to the head 31. Thus, the dots just after formation on the medium by the head 31 can be cured (the provisional curing). As described above, the provisional curing is performed at the period in which the head 31 moves in the movement direction and performed in the same pass as forming the dots. In addition, the light sources (the LEDs) of the first irradiation sections 42*a* and 42*b* are accommodated inside the first irradiation sections 42*a* and 42*b* respectively so that the light sources are isolated from the head 31. Accordingly, the UV irradiating from the light source is prevented from leaking to the lower surface of the head 31 and then the UV ink is prevented from curing (clogging of the nozzle) adjacent to the opening of each of the nozzles formed at the lower surface thereof.

As shown in FIG. 2, the second irradiation sections 43*a* and 43*b* are also disposed at the carriage 21 respectively. The second irradiation section 43*a* is disposed at one end of the carriage 21 in the movement direction to the downstream side in the transportation direction of the first irradiation section 42*a*, and the second irradiation section 43*b* is disposed at the other end of the carriage 21 in the movement direction to the downstream side in the transportation direction of the second irradiation section 42*b*. In other words, the second irradiation sections 43*a* and 43*b* are disposed to the downstream side from the nozzle column of the head 31 in the transportation direction. The controller 60 also allows the UV to irradiate from the second irradiation sections 43*a* and 43*b* at the time of pass. At this time, the dots where the second irradiation sections 43*a* and 43*b* irradiate the UV are the dots (the dots cured by the first irradiation sections 42*a* and 42*b*) formed already in the previous pass on the medium.

Relationship Between Provisional Curing and Dot Formation

As described above, in the embodiment, the curing is performed in two-step (the provisional curing and the main curing). The provisional curing thereof is the UV irradiation to suppress the flow (widening) of the dots or the spread between dots formed on the medium. Thus, the dot after the provisional curing is not completely cured, and the final dot shape is decided by the provisional curing.

Figure 7A:
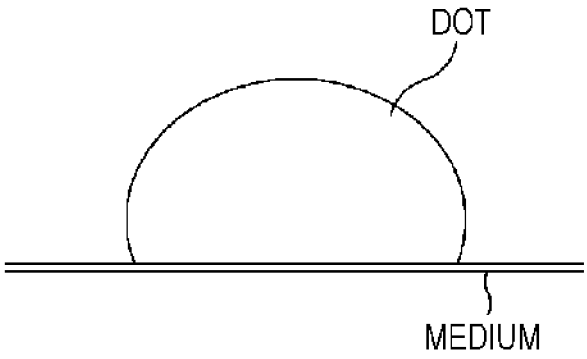
FIGS. 7A to 7C are explanatory views of the relationship between a shape of a UV ink (dots) that impacts on a medium and irradiation energy of a UV of a provisional curing.
Figure 7B:
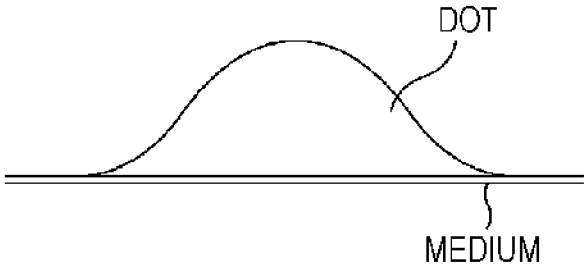
Figure 7C:
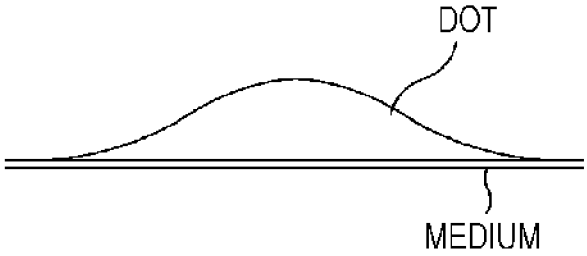

FIGS. 7A to 7C are explanatory views between the shape of the UV ink (dots) impacted on the medium and irradiation energy of the UV of the provisional curing. The irradiation energy of the UV in the provisional curing lowers in the order of FIG. 7A, FIG. 7B and FIG. 7C. In addition, timings of the UV irradiation on the dots are the same as each other (just after the formation of the dots) in each view.

If the irradiation energy of the UV is high at the time of the provisional curing, for example, as shown in FIG. 7A, the flow of the dot decreases. In this case, since the unevenness of the medium surface is large, it becomes a low gloss image quality of (a mat tone) where the gloss of the surface is suppressed. In addition, in this case, bleeding hardly occurs between other inks.

Meanwhile, if the irradiation energy of the UV is low at the time of the provisional curing, for example, as shown in FIG. 7C, the flow of the dot increases. In this case, since the unevenness of the medium surface is small, it becomes high gloss image quality (a gloss tone) where the gloss of the surface is increased. In addition, in this case, bleeding easily occurs between other inks.

As described above, the irradiation condition of the UV just after the dot formation is changed so that the finish state (feeling) of the image can be regulated. The printer 1 of the embodiment includes the first irradiation sections 42*a* and 42*b*. Accordingly, the irradiation condition of the UV is changed so that the feeling of the image can be regulated. However, if the irradiation energy of the UV irradiation (the UV irradiation of the main curing) performing after the provisional curing is fixed, the irradiation energy of the UV at the time of the provisional curing changes so that there is concern that the dots cannot reliably cure or there is concern that the energy is wasted.

In the embodiment, the feeling of the image can be regulated while achieving the optimization of the irradiation condition of the UV.

Setting of Print Mode and UV Irradiation Condition

Figures 8, 9:
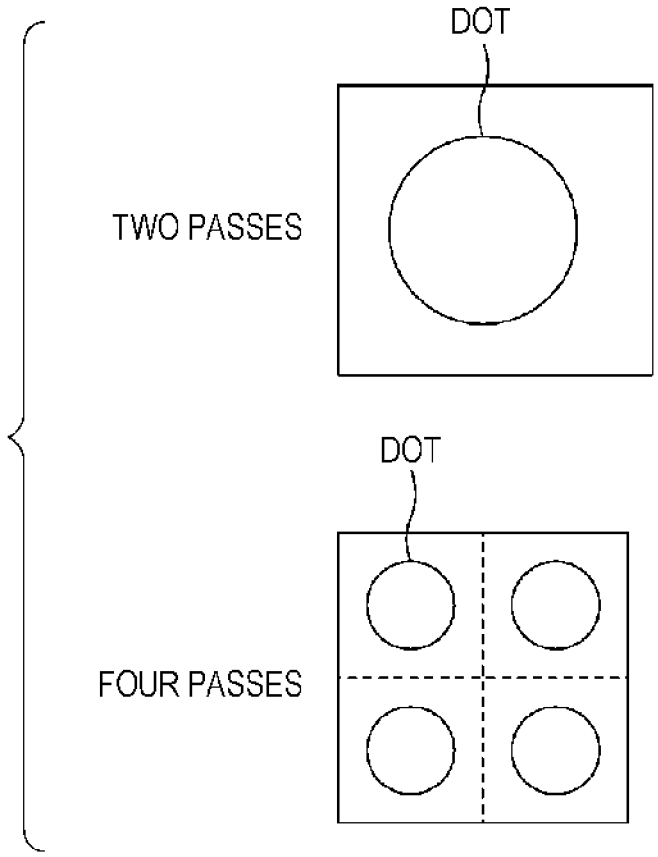
FIG. 8 is an explanatory view of setting of a printing method and a UV irradiation condition of the first embodiment.
FIG. 9 is a conceptual view of dots formed on unit area respectively in a printing method of a two-pass and a four-pass printing method.

FIG. 8 is an explanatory view of setting of the printing method and the UV irradiation condition in the first embodiment. The printer 1 of the embodiment performs two print modes (fast mode and high image quality mode) as the printing methods. The fast mode performs the dot formation through two passes as described above, and the high image quality mode performs the dot formation through four passes as described above.

In addition, in each of print modes, three of A to C are established as the finish state of the image. The finish state A is the low gloss image quality (the mat tone), the finish state C is the image quality of high gloss (the gloss tone). In addition, the finish state B is a state of an intermediate state of the finish state A (the mat tone) and the finish state C (the gloss tone).

In addition, the setting values of the irradiation intensity of UV in each of irradiation section are illustrated in the view. The setting values are illustrated in five steps from the minimum intensity to the maximum intensity. "1" is the minimum and "5" is the maximum. The controller 60 performs control of the irradiation intensity through changing the input current to the LED of the light source of each irradiation section.

Fast Mode

As described above, the finish state of the image can be regulated by receiving the UV irradiation just after the dot formation. In the case of the embodiment, the amount of the UV irradiation of the first irradiation sections 42*a* and 42*b* is changed so that the finish states can be regulated. As shown in the view, the controller 60 changes the irradiation intensity of the first irradiation sections 42*a* and 42*b* according to the finish state set by the user through the user interface. Furthermore, the controller 60 changes the irradiation intensity of the second irradiation sections 43*a* and 43*b* according to the irradiation intensity of the first irradiation sections 42*a* and 42*b*.

For example, if the finish state A (the mat tone) is set, the irradiation intensity of the first irradiation sections 42*a* and 42*b* is "5", and the irradiation intensity of the second irradiation sections 43*a* and 43*b* is "2". In other words, in the pass at the time of the dot formation, the UV is irradiated with the maximum irradiation intensity in the first irradiation sections 42*a* and 42*b* so that the provisional curing is performed on the dots in a state shown in FIG. 7A. Thus, in the pass after that, the UV is irradiated with a relatively low irradiation intensity in the second irradiation sections 43*a* and 43*b* so that the main curing is performed on the dots.

In addition, if the finish state C (the gloss tone) is set, the irradiation intensity of the first irradiation sections 42*a* and 42*b* is "2", and the irradiation intensity of the second irradiation sections 43*a* and 43*b* is "5". In other words, in the pass at the time of the dot formation, the UV is irradiated with a relatively low irradiation intensity in the first irradiation sections 42*a* and 42*b* so that the provisional curing is performed on the dots in a state shown in FIG. 7A. Thus, in the pass after that, the UV is irradiated with the maximum irradiation intensity in the second irradiation sections 43*a* and 43*b* so that the main curing is performed on the dots. Accordingly, the energy is not wasted and the dots can be reliably cured regardless of the finish states.

High Image Quality Mode

Even in the high image quality mode, similar to the fast mode, the controller 60 set the irradiation intensity of the first irradiation sections 42*a* and 42*b*, and the irradiation intensity of the second irradiation sections 43*a* and 43*b* respectively according to the finish state set by the user. However, as shown in the view, in the high image quality mode, the entire irradiation intensity of the UV of each irradiation section is lower than the fast mode. Hereinafter, the reason will be described. In addition, as described above, the high image quality is a printing method (see FIG. 6) through four passes while the above described fast mode is the printing method (see FIG. 5) through two passes.

FIG. 9 is a conceptual view of the dots forming on a unit area respectively in the two-pass printing method and the four-pass printing method. As seen from the view, the resolutions in the two-pass printing method and the four-pass printing method are different from each other. In other words, the number of dots formed on the unit area is different from each other. Specifically, one dot per the unit area is formed in two passes while four dots per the unit area are formed in four passes. Thus, the dot size of the dot formed in four passes is smaller than the size of the dot formed in two passes. In other words, the irradiation intensity of the UV required to cure the dots in four passes is smaller than that in two passes. Thus, in the high image quality mode (four passes), the entire irradiation intensity of the UV is set lower than that of the fast mode (two passes).

In addition, even in the high image quality, the controller 60 changes the irradiation intensity of the first irradiation sections 42*a* and 42*b* according to the finish state, furthermore, changes the irradiation intensity of the second irradiation sections 43*a* and 43*b* according to the irradiation intensity of the first irradiation sections 42*a* and 42*b*. By doing this, the energy is not wasted and the dots can be reliably cured regardless of the finish states.

As described above, the printer 1 of the embodiment has the head 31 ejecting the UV ink. The printer 1 includes the carriage 21 that moves in the movement direction intersecting the transportation direction, the first irradiation sections 42*a* and 42*b* and the second irradiation sections 43*a* and 43*b* that are disposed at the carriage 21 and irradiates the UV, and the controller 60 that forms the image on the medium through performing the pass where the ink is ejected from the head 31 while moving the carriage 21 in the movement direction and through performing the transportation direction that transports the medium in the transportation direction. The first irradiation section 42*a* is arranged at one end side from the head 31 at the carriage 21 in the movement direction, and the first irradiation section 42*b* is arranged at the other end side from the head 31 in the movement direction. In addition, the second irradiation sections 43*a* and 43*b* are arranged to the downstream side from the first irradiation sections 42*a* and 42*b* in the transportation direction.

Thus, the controller 60 performs control of the irradiation intensity of the UV of the first irradiation sections 42*a* and 42*b* at the time of the pass so as to regulate the finish state of the image and to change the irradiation intensity of the UV of the second irradiation sections 43*a* and 43*b* according to the irradiation intensity of the first irradiation sections 42*a* and 42*b*.

Accordingly, the energy is not wasted and the dots can be reliably cured regardless of the finish states (feeling) of the image. In other words, desired image can be printed while achieving the optimization of the irradiation condition of the UV.

In addition, such a case is also considered in which the main curing is not permitted even though the UV is irradiated with the strongest irradiation intensity according to the print condition (type of ink, types of media, print environment or the like). In this case, the transportation operation is not performed after the pass, and an empty pass (corresponding to the irradiation operation) that performs only the UV irradiation from each of irradiation sections may be performed while moving the carriage 21 in the movement direction. Accordingly, the cumulative amount of the UV irradiation can be increased and the dots can be further reliably cured. Otherwise, other irradiation section for the main curing may be disposed on the transportation route to the downstream side from the carriage 21 in the transportation direction so that the length thereof in the movement direction is longer than the maximum width of the medium to be the printing object.

In the embodiment, the UV is irradiated from any one of the second irradiation sections 43*a* and 43*b*, however, the UV may be irradiated from both the second irradiation sections 43*a* and 43*b*.

Second Embodiment

Figure 10:
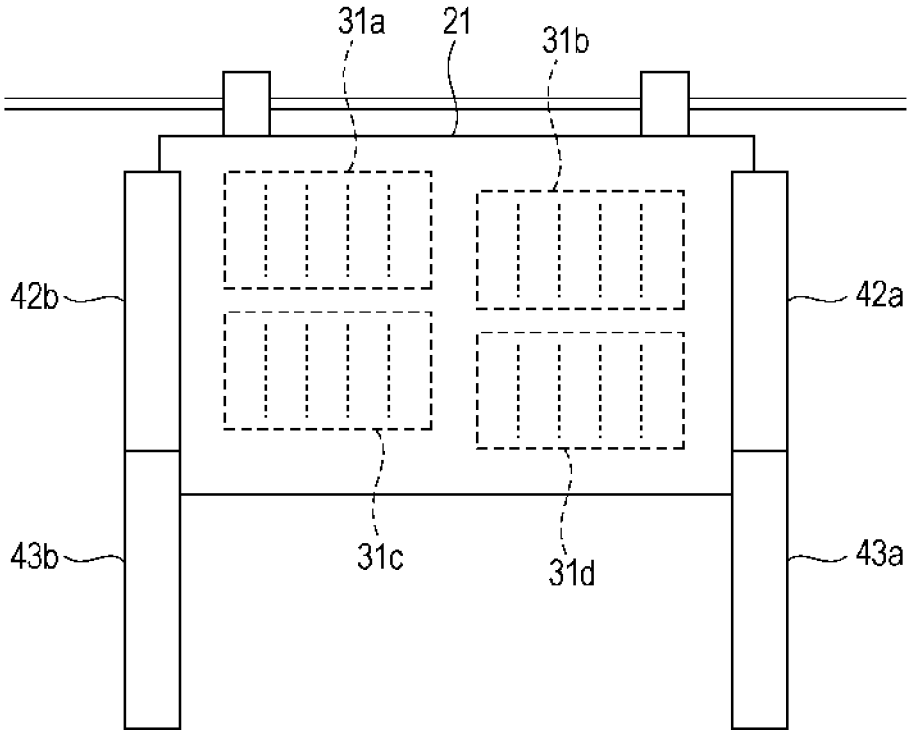
FIG. 10 is an explanatory view of a head portion of a second embodiment.
Figure 10:
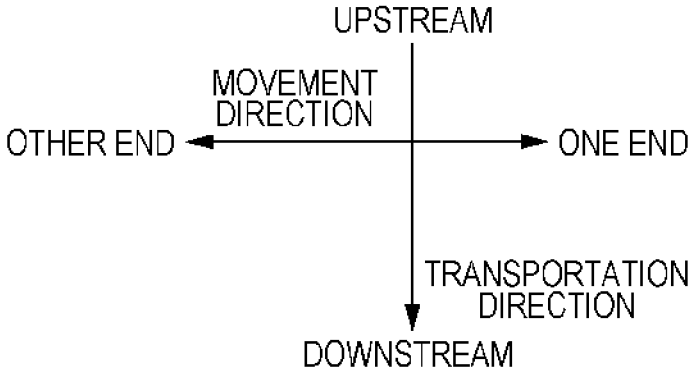

FIG. 10 is an explanatory view of a head portion of a second embodiment. In the second embodiment, the configuration of the head is different from the first embodiment.

In the second embodiment, the carriage 21 includes four heads (the heads 31*a*, 31*b*, 31*c* and 31*d*). In addition, similar to the first embodiment, the carriage 21 includes the first irradiation sections 42*a* and 42*b*, and the second irradiation sections 43*a* and 43*b*.

The head 31*a* and the head 31*c* are arranged lined up in the transportation direction at the other end in the movement direction. In addition, the head 31*b* and the head 31*d* are arranged lined up in the transportation direction at one end in the movement direction. In addition, each of heads is arranged respectively in shifted manner in the transportation direction.

The first irradiation sections 42*a* and 42*b* are disposed respectively outside each of the heads so as to interpose four heads.

In addition, the second irradiation sections 43*a* and 43*b* are disposed respectively at the downstream side of the first irradiation sections 42*a* and 42*b* in the transportation direction.

The length of the first irradiation sections 42*a* and 42*b* and the second irradiation sections 43*a* and 43*b* in the transportation direction is the same as the length of the nozzle column configured of four heads.

The print operation (the dot formation and the UV irradiation) of the second embodiment is the same as the first embodiment therefore the description thereof will be omitted.

Also in the second embodiment, after the provisional curing is performed by the first irradiation sections 42*a* and 42*b*, and the finish state is regulated, the main curing is performed by the second irradiation sections 43*a* and 43*b*. Accordingly, the optimization of the condition of the UV irradiation is achieved and desired image can be printed.

In addition, in the second embodiment, the head 31*a* and the head 31*b* at the downstream side in the transportation direction, and the head 31*c* and the head 31*d* at the upstream side in the transportation direction may perform the dot formation individually. For example, the color inks (CMYK) are ejected with the head 31*a* and the head 31*b* at the downstream side in the transportation direction to form the image. After that, the medium is transported by as much as the length of the nozzle column of each of the heads so that the clear ink is ejected from the head 31*c* and the head 31*d* and the clear ink may be coated on the color image. In this case, just after color image is formed, the UV for the provisional curing may be irradiated from the half region at the downstream side of the first irradiation sections 42*a* and 42*b* in the transportation direction, and just after the clear ink is coated, the UV for the provisional curing may be irradiated from the half region at the upstream side of the first irradiation sections 42*a* and 42*b* in the transportation direction. Thus, after that, the UV for the main curing may be irradiated from the second irradiation sections 43*a* and 43*b*.

Otherwise, the white ink (W) is ejected from the head 31*a* and the head 31*b* at the downstream side in the transportation direction a background image is formed on the medium, after that, the medium is transported by as much as of the nozzle column of each of heads. The color ink is ejected from the head 31*c* and the head 31*d* in the next pass and then the color image may be formed on the background image. In this case, just after the background image is formed, the UV for the provisional curing may be irradiated from the half region at the downstream side of the first irradiation sections 42*a* and 42*b* in the transportation direction, and just after the color image is formed, the UV for the provisional curing may be irradiated from the half region at the upstream side of the first irradiation sections 42*a* and 42*b* in the transportation direction. Thus, after that, the UV for the main curing may be irradiated from the second irradiation sections 43*a* and 43*b*.

Even in these cases, similar to the above described embodiment, the irradiation intensity of the first irradiation sections 42*a* and 42*b* may be changed according to the finish state and the irradiation intensity of the second irradiation sections 43*a* and 43*b* may be changed according to the irradiation intensity of the first irradiation sections 42*a* and 42*b*.

Other Embodiments

The printer or the like has been described as one of embodiments, however, the above described embodiments are for ease of understanding the invention and are not to be construed as limiting the invention. The invention can be modified and improved without departing from the spirit thereof and it is understood that equivalents thereof are also included in the invention. Specifically, embodiments described below are also included in the invention.

Printer

In the above described embodiments, a printer has been described as an example of the apparatus, the invention is not limited to the embodiments. For example, the same technology as the embodiments may be applied to various liquid ejecting apparatus that applies ink jet technology such as a color filter manufacturing apparatus, a dyeing apparatus, a fine processing apparatus, a semiconductor manufacturing apparatus, a surface processing apparatus, a three-dimensional molding machine, a liquid vaporizer, an organic EL manufacturing apparatus (specifically, polymer EL manufacturing apparatus), a display manufacturing apparatus, a film formation apparatus, a DNA chip manufacturing apparatus or the like.

Nozzle

In the above described embodiments, the ink has been ejected using the piezoelectric element (the piezo element). However, the method of ejecting the liquid is not limited to the embodiments. For example, other methods may be used such as a method of generating bubbles inside the nozzle by receiving heat or the like.

Ink

In the above described embodiments, the ink (the UV ink) that is cured by receiving the irradiation of ultraviolet rays (UV) has been ejected from the nozzle. However, the liquid ejecting from the nozzle is not limited to the above described ink, liquid that is cured by receiving the irradiation of other light (for example, visible ray, or the like) except the UV may be ejected from the nozzle. In this case, the light (for example, visible light or the like) for curing the liquid may be irradiated from each of irradiation sections.

Printing Method

In the above described embodiments, the description has been made regarding the band print (the printing method that combines a fine transportation filling between the nozzle pitch D and the transportation as many as the nozzle column), however, the invention is not limited to the embodiment, and other printing methods may be used. For example, the invention may be microwave printing where the dots that are formed by the same nozzle are not adjacent to each other.

Medium

In the above described embodiments, the printing is performed on the same types of media in each of the print modes, however, there is a case that the widening method of the ink (dot) may be varied according to the type of medium. In this case, the irradiation intensity of each of the irradiation sections may be changed according to the types of media. For example, in a case where the printing is performed on the medium in which the ink is easily widened, the irradiation intensity of each of the irradiation sections may be entirely increased. On the contrary, in a case where the printing is performed on the medium in which the ink is difficult to widen, the irradiation intensity of each of the irradiation sections may be entirely decreased. Accordingly, the optimization of the irradiation condition can be further achieved.

Irradiation Section

In the above described embodiments, the first irradiation section 42*a* and the first irradiation section 42*b* are disposed at both ends of the carriage 21 in the movement direction respectively, however, it may be disposed on one of either. In addition, for example, if the printing is performed in a single direction, when the first irradiation section is disposed at the upstream side of the head 31 in the movement direction in the pass that forms the dot, the UV irradiation for the provisional curing can be performed just after the dot formation.

In the above described embodiments, the second irradiation section 43*a* and the second irradiation section 43*b* are disposed at the downstream side of the first irradiation section 42*a* and the first irradiation section 42*b* in the transportation direction respectively, however, the invention is not limited to the embodiment. For example, any one of the second irradiation section 43*a* and the second irradiation section 43*b* may be disposed. One irradiation section that has the same configuration as the second irradiation sections 43*a* and 43*b* may be disposed at the center (at the downstream side from the head 31 in the transportation direction) of the movement direction of the carriage 21. Even in this case, the UV of the main curing can be irradiated at a pass after the dot formation pass. In addition, the second irradiation section may be disposed at a location other than the carriage 21. For example, the second irradiation section may be disposed on the transportation route at the downstream side from the carriage 21 in the transportation direction. Thus, when the medium is transported in the transportation direction, the UV for the main curing may be irradiated on the dots (the dots after the provisional curing) formed on the medium. However, as the embodiment, when the second irradiation section is disposed at the carriage 21, the second irradiation section can irradiate the UV while moving with the carriage 21 in the movement direction so that the second irradiation section can be miniaturized.

The entire disclosure of Japanese Patent Application No. 2011-103113, filed May 2, 2011 is expressly incorporated by reference herein.

What is claimed is:

1. A liquid ejecting apparatus comprising:

a carriage that has a head ejecting liquid cured by receiving the irradiation of light and moves in a movement direction intersecting a transportation direction of a medium;

a first irradiation section that is disposed at the carriage, irradiates the light and is arranged at an upstream side or a downstream side from the head in the movement direction;

a second irradiation section that irradiates the light and is arranged at the downstream side from the first irradiation section in the transportation direction; and a controller that forms the image on the medium through performing an ejection operation ejecting the liquid from the head while moving the carriage in the movement direction and a transportation operation that transports the medium in the transportation direction, and performs control of an irradiation intensity of the light of the first irradiation section at the time of the ejection operation to regulate the surface condition of the image and to change the irradiation intensity of the light of the second irradiation section according to the irradiation intensity of the light of the first irradiation section, wherein the controller changes the irradiation intensity of the light of the first irradiation section and the second irradiation section according to types of media, wherein when the controller performs a first print mode that forms dots at a predetermined region on the medium through performing the ejection operation n times (n is a natural number), or a second print mode that forms dots at the predetermined region through performing the ejection operation m times (m is a natural number larger than n) and then the image of the predetermined surface condition is printed, the irradiation intensity of the light of each of the irradiation sections in the second print mode is decreased less than the irradiation intensity of the light of each of the irradiation sections in the first print mode.

2. A liquid ejecting method that forms an image on a medium through performing a transportation operation that transports the medium in the transportation direction and an ejection operation ejecting liquid from a head with the irradiation of the light while moving a carriage having the head in a movement direction intersecting the transportation direction, the method comprising:

regulating a surface condition of the image with controlling the irradiation intensity of the light of a first irradiation section that is disposed at the carriage and arranged at an upstream side or a downstream side from the head in the movement direction at the time of the ejection operation; and changing the irradiation intensity of the light of a second irradiation section disposed at the downstream side from the first irradiation section in the transportation direction according to the irradiation intensity of the light of the first irradiation section, performing a first print mode that forms dots at a predetermined region on the medium through performing the ejection operation n times (n is a natural number), or a second print mode that forms dots at the predetermined region through performing the ejection operation m times (m is a natural number larger than n) and then the image of the predetermined surface condition is printed, the irradiation intensity of the light of each of the irradiation sections in the second print mode is decreased less than the irradiation intensity of the light of each of the irradiation sections in the first print mode.

3. A liquid ejecting apparatus comprising:

a carriage that has a head ejecting liquid cured by receiving the irradiation of light and moves in a movement direction intersecting a transportation direction of a medium;

a first irradiation section that is disposed at the carriage, irradiates the light and is arranged at an upstream side or a downstream side from the head in the movement direction;

a second irradiation section that irradiates the light and is arranged at the downstream side from the first irradiation section in the transportation direction; and a controller that forms the image on the medium through performing an ejection operation ejecting the liquid from the head while moving the carriage in the movement direction and a transportation operation that transports the medium in the transportation direction, and performs control of an irradiation intensity of the light of the first irradiation section at the time of the ejection operation to regulate the surface condition of the image and to change the irradiation intensity of the light of the second irradiation section according to the irradiation intensity of the light of the first irradiation section, wherein when the controller performs a first print mode that forms dots at a predetermined region on the medium through performing the ejection operation n times (n is a natural number), or a second print mode that forms dots at the predetermined region through performing the ejection operation m times (m is a natural number larger than n) and then the image of the predetermined surface condition is printed, the irradiation intensity of the light of each of the irradiation sections in the second print mode is decreased less than the irradiation intensity of the light of each of the irradiation sections in the first print mode.

4. The liquid ejecting apparatus according to claim 3, wherein the controller allows the irradiation intensity of the light of the first irradiation section to be a first intensity and the irradiation intensity of the light of the second irradiation section to be a second intensity when the image is a certain surface condition, and wherein the controller allows the irradiation intensity of the light of the first irradiation section to decrease less than the first intensity and the irradiation intensity of the light of the second irradiation section to increase more than the second intensity when the image is a surface condition of gloss higher than the certain surface condition.

5. The liquid ejecting apparatus according to claim 3, wherein the controller performs the irradiation operation that allows each of irradiation sections to irradiate the light while moving the carriage in the movement direction without ejecting the liquid from the head between the ejection operation and the transportation operation.

6. The liquid ejecting apparatus according to claim 3, wherein the second irradiation section is disposed at the carriage.

* * * * *